US005129163A

United States Patent [19]

Yamazaki et al.

[11] Patent Number: 5,129,163

[45] Date of Patent: Jul. 14, 1992

[54] MULTISTAGE TENTER

[75] Inventors: Takeshi Yamazaki; Sanshiro Fukuhara, both of Kanagawa; Hiromu Saijo, Shizuoka; Koichi Kanazawa, Shizuoka; Nobuyuki Hayabusa, Shizuoka, all of Japan

[73] Assignees: Fuji Photo Film Co., Ltd., Kanagawa; Toshiba Machine Co., Ltd., Tokyo, both of Japan

[21] Appl. No.: 458,261

[22] Filed: Dec. 28, 1989

[30] Foreign Application Priority Data

Dec. 28, 1988 [JP] Japan ..... 63-333110
Jan. 5, 1989 [JP] Japan ..... 64-651

[51] Int. Cl.[5] ..... F26B 13/00

[52] U.S. Cl. ..... 34/158; 198/803.3; 198/803.4

[58] Field of Search ..... 34/158, 162; 198/803.3, 198/803.4; 226/104, 106; 26/51, 51.4

[56] References Cited

U.S. PATENT DOCUMENTS 3,149,003 9/1964 Christie et al. ..... 34/158 X
3,296,712 1/1967 Sachs ..... 34/158 X

*Primary Examiner*—Henry A. Bennet
*Attorney, Agent, or Firm*—Sughrue, Mion, Zinn, Macpeak & Seas

[57] ABSTRACT

In a multistage tenter with the right and left clip chains for conveying a belt-shaped film in a drying unit, a tensing mechanism operates to slide the supports of a pair of right and left sprockets engaged with the clip chains to tension the latter simultaneously, so that the shorter of the two clip chains is automatically tensioned more than the other, whereby the pitch error of the clip chains is absorbed, and the film is accordingly prevented from being wrinkled while being conveyed.

11 Claims, 12 Drawing Sheets

MULTISTAGE TENTER

BACKGROUND OF THE INVENTION

This invention relates to a multistage tenter used to process belt-shaped sheets or webs such as belt-shaped films.

A conventional multistage tenter of this type is known as shown in FIG. 10. The multistage tenter has a drying unit 1 in which endless clip chains 2 are laid over sprockets 3, 4, 5, 6, and 7. The sprockets 6 are driven by a drive source (not shown), so that two clip chains 2 and 2 engaged with these sprockets 3 through 7 as shown in FIG. 11 are driven, whereby a belt-shaped film 8 (hereinafter referred to merely as "a film 8", when applicable) is inserted into the drying unit 1 through a film inlet formed in its side wall. The film 8 thus inserted is conveyed downwardly while changing the direction of movement (or being bent) so that it is dried in the drying unit. The film thus dried is moved out of the drying unit passing through a film removing roll 9.

The clip chains 2 are constructed as shown in FIGS. 12 and 13. Two coupling pins 11 and 11 are secured to the side walls 10*a* of each clip body 10. Rotors 12 and 12 are provided at first ends of the coupling pins 11 in such a manner that they are disposed between the confronted surfaces of guide rails 13 and 13 which are provided above and below the rotors 12 and 12. A pin plate 14 is coupled to the other ends of the coupling pins 11. Rotors 15 and 15 and rotors 16 and 16 are provided obliquely above and obliquely below each of the rotors 12 in such a manner that they are abutted against the guide rails 13, as shown in FIGS. 12 and 13.

Each coupling pin 11 is inserted into a bushing 17, which is inserted into a roller 18. A pair of chain links 19 and 19 are mounted on the bushing 17 in such a manner that they are located on both sides of the roller 18. In FIG. 12, reference character 3*a* designates the teeth of the sprockets. The sprockets 4, 5 and 6 adapted to change the direction of movement of the clip chains 2 are equal in construction to one another. As shown in FIGS. 14 and 15, the right and left sprockets 4 are supported through bearings 21 on shafts 20, and distance adjusting device 22 for adjusting the distance between the right and left sprockets 4 is provided below the bearings 22, respectively.

Each of the right and left sprockets 7 is provided with a tensioning mechanism 23 which is as shown in FIGS. 16 and 17. This will be described in more detail. The sprocket 7 and a hydraulic cylinder 24 are arranged in the middle of a rectangular frame 25 in such a manner that they are spaced from each other and are in parallel with each other. Four sprocket holders 26 are arranged near the four corners of the frame 25, respectively. Chains 28 and 28 are connected under tension, with the aid of the sprocket holders 26, between the piston rods 24*a* and 24*a* protruded from both ends of the hydraulic cylinder 24 and both sides of a bearing frame 27 provided below the sprocket 7, respectively. The tension of the chains 28 is detected by a tension detecting load cell 29.

In the conventional multistage tenter thus constructed, each of the clip chains is of the order of 40 to 60 meters. With the conventional multistage tenter, in order to reduce the time required for drying a film, it is necessary to increase the heating temperature. However, increase of the heating temperature may wrinkle the surface of the film. In order to effectively dry the film at a suitable, relatively low temperature, it is necessary to increase the length of the heating section, and accordingly to increase the length of the clip chains. If each clip chain is increased in length, then the number of chain links forming the clip chain is increased accordingly, with the result that the pitch errors of the chain links are accumulated, providing a large accumulative pitch error as a whole. This large accumulative pitch error will result in the difference in length between the right and left clip chains. The difference should be 10 mm or less per 100 m with the clip chains laid between the film inlet and the film outlet. However, in the case where the clip chain is of the order of 200 m, it is rather difficult to reduce the difference to 10 mm or less. In order to meet the requirement, a method is employed in which chain links substantially equal in hole pitch are selected as pairs, which are distributed uniformly to the right and left clip chains. However, to do so would take a lot of time and labor. On the other hand, in the multistage tenter, the effect of the difference between the right and left clip chains is large where the direction of movement of the clip chains is changed by the sprockets.

Furthermore in the conventional multistage tenter, the right and left sprockets for changing the direction of movement of the clip chains are provided individually; that is, they are rotated separately, and accordingly the movements of the right and left clip chains are not synchronous with each other. Hence, the accumulative pitch errors of the right and left clip chains are not absorbed, and the difference in length of the right and left clip chains, which is due to the accumulative pitch errors, will form wrinkles on the film.

The clip chain tensioning mechanisms are provided for the right and left sprockets, respectively. The tensions of the right and left clip chains are detected, so that the clip chain shorter is tensioned by the respective hydraulic cylinder more than the other. However, it is rather difficult to adjust the tensions of the clip chains with their own hydraulic cylinders separately thereby to absorb the difference in length therebetween in order to prevent the formation of wrinkles on the film.

SUMMARY OF THE INVENTION

Accordingly, an object of this invention is to eliminate the above-described difficulties accompanying a conventional multistage tenter.

More specifically, an object of the invention is to provide a multi-stage tenter in which the right and left clip chains are tensioned simultaneously by one and the same drive source so that the shorter of the two clip chains is automatically tensioned more than the other; that is, the former is elongated more than the latter, whereby the pitch error is absorbed, and the film handled thereby is prevented from being wrinkled.

Another object of the invention is to provide a multistage tenter in which the chain links of the clip chains are engaged with the middles of the coupling pins engaged with the teeth of the sprockets to deflect the coupling pins thereby to prevent the formation of wrinkles on the film handled thereby.

The foregoing objects and other objects of the invention have been achieved by the provision of a multistage tenter with the right and left clip chains for conveying a belt-shaped film in a drying unit, in which, according to the invention, a pair of right and left sprockets engaged with the clip chains have each teeth arranged in two lines and confronted with each other, a tensioning mechanism operates to slide the supports of the sprockets thereby to tension the right and left clip chains simultaneously.

In the multistage tenter, the teeth of each of the sprockets are spaced in such a manner that they are removed every other one, and the chain links of the clip chains are engaged with the middle portions of coupling pins which are engaged with the teeth of the sprockets.

Furthermore in the multistage tenter, a plurality of right and left sprockets for changing the direction of movement of said clip chains are connected through shafts, respectively, and drive sources are provided for the sprockets, respectively, to distribute the force of driving the clip chains to the sprockets.

In the multistage tenter of the invention, both edge portions of a belt-shaped film are supported by the clip chains, and the tensioning mechanism using one pressure source applies tensile force to the supports of a pair of right and left sprockets engaged with the clip chains simultaneously. Therefore, one of the clip chains which is shorter in length is automatically tensioned more than the other, as a result of which the two clip chains are made equal in length to each other, and accordingly the film is protected from being wrinkled.

Furthermore in the multistage tenter, since the chain links of the clip chains are engaged with the middle portions of the coupling pins, the latter are deflected so as to make the right and left clip chains equal in length with small tensile force.

Moreover in the multistage tenter of the invention, when with both edge portions of a belt-shaped film supported by the right and left clip chains, the drive sources are operated to drive the plurality of sprockets for changing the direction of conveyance of the film, those sprockets are rotated synchronously because the right and left sprockets are connected through the respective shafts. Hence, the right and left clip chains are made equal in the speed of conveyance, and the power for driving the clip chains is distributed to the drive sources. As a result, the difference in length between the right and left clip chains attributing to the pitch errors of the latter is absorbed, whereby the variation in speed of the clip chains is reduced, and accordingly the difficulties are eliminated that the film is wrinkled and made non-uniform in thickness.

The nature, principle and utility of the invention will become more apparent from the following detailed descriptions and the appended claims when read in conjunction with the accompanying drawings.

Figure 10:
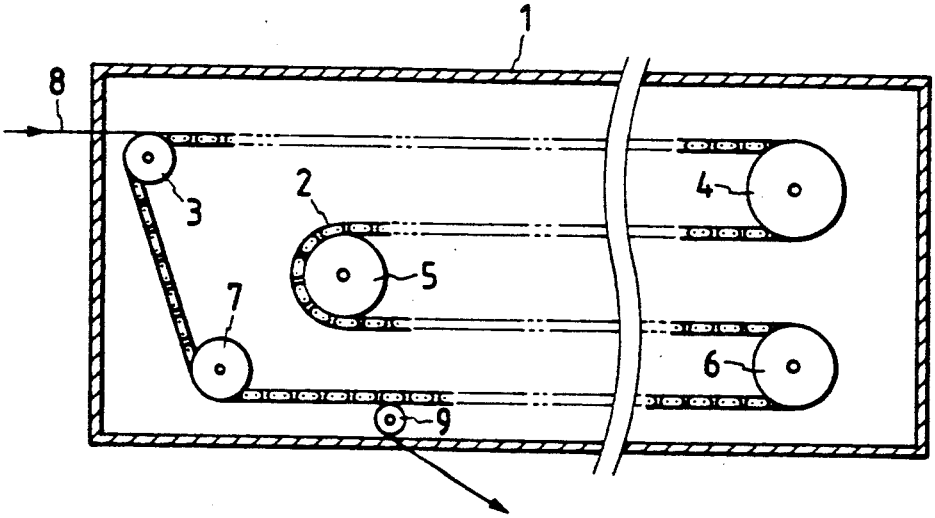
Figure 11:
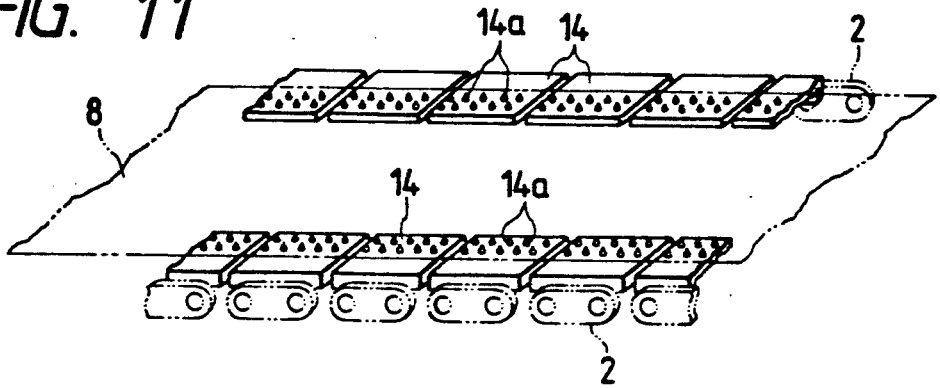
Figure 12:
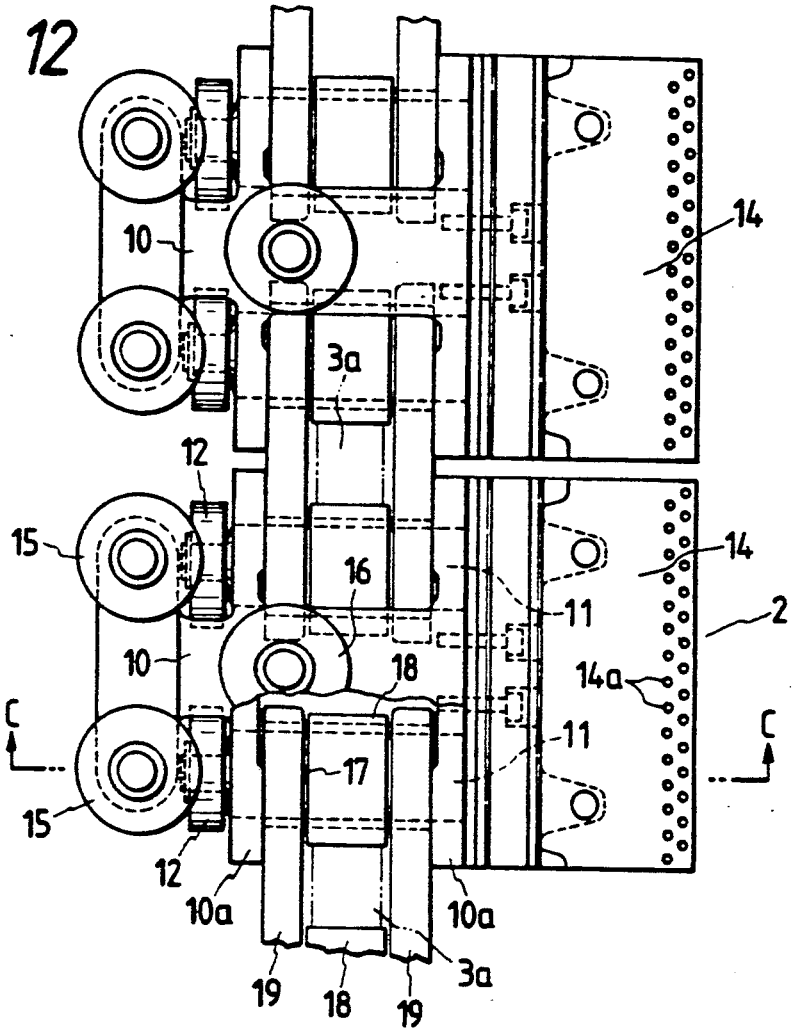
Figure 13:
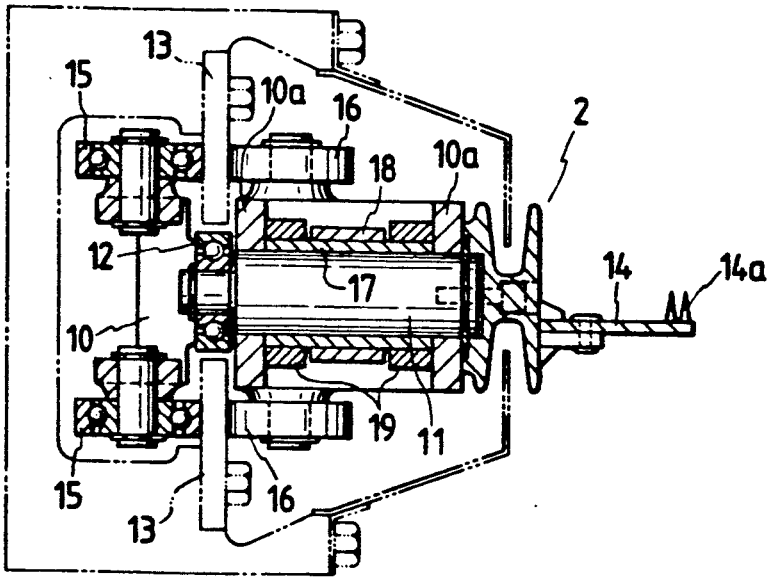
Figure 14:
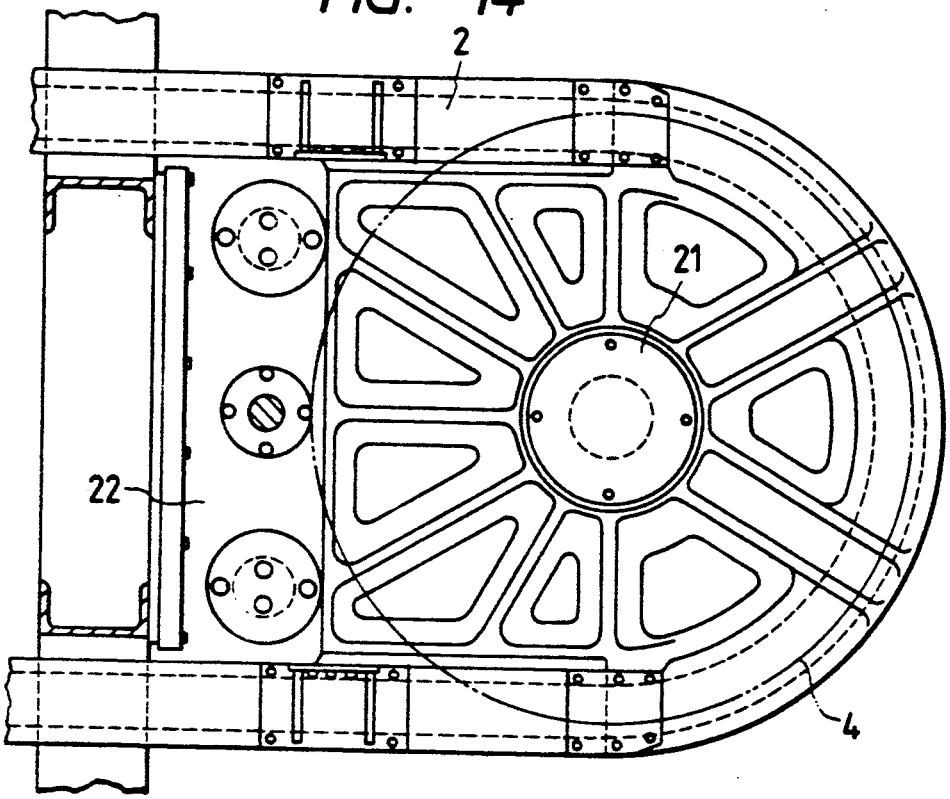
Figure 15:
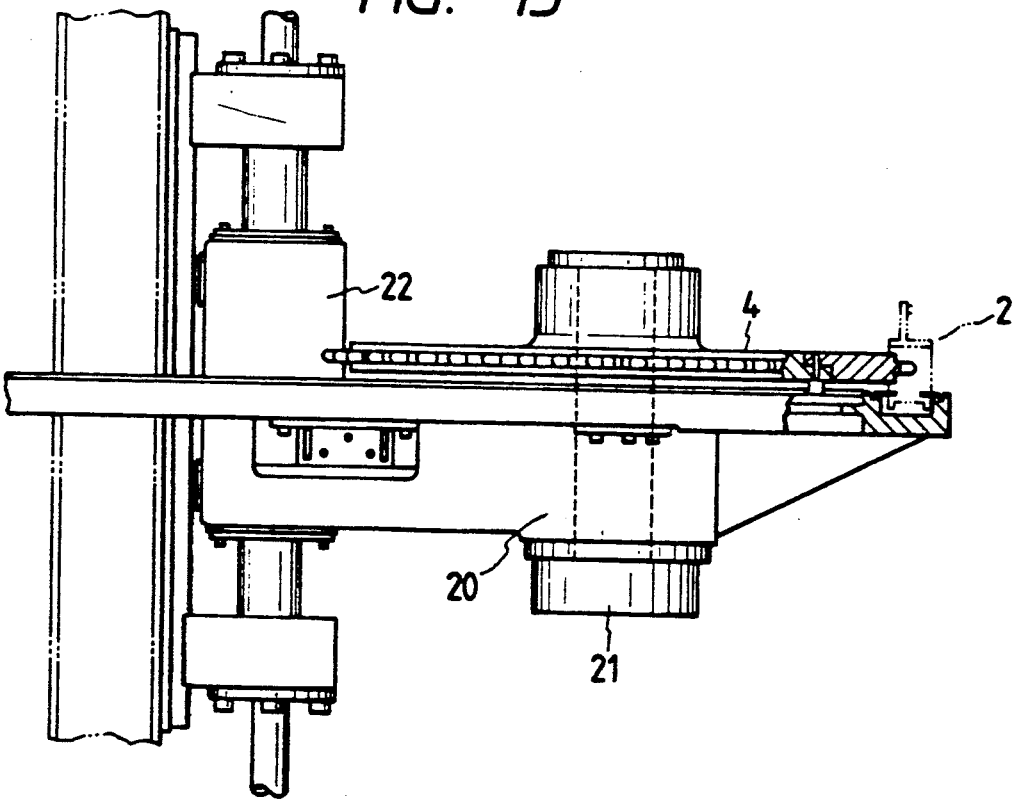
Figure 16:
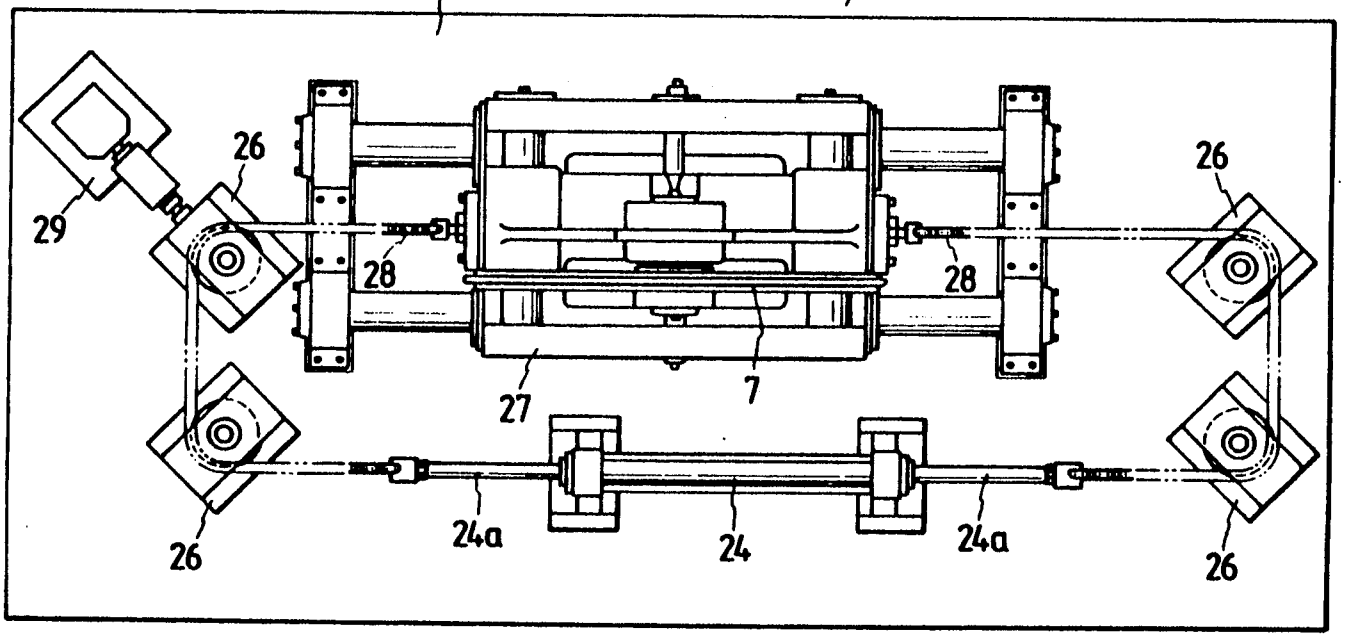
Figure 17:
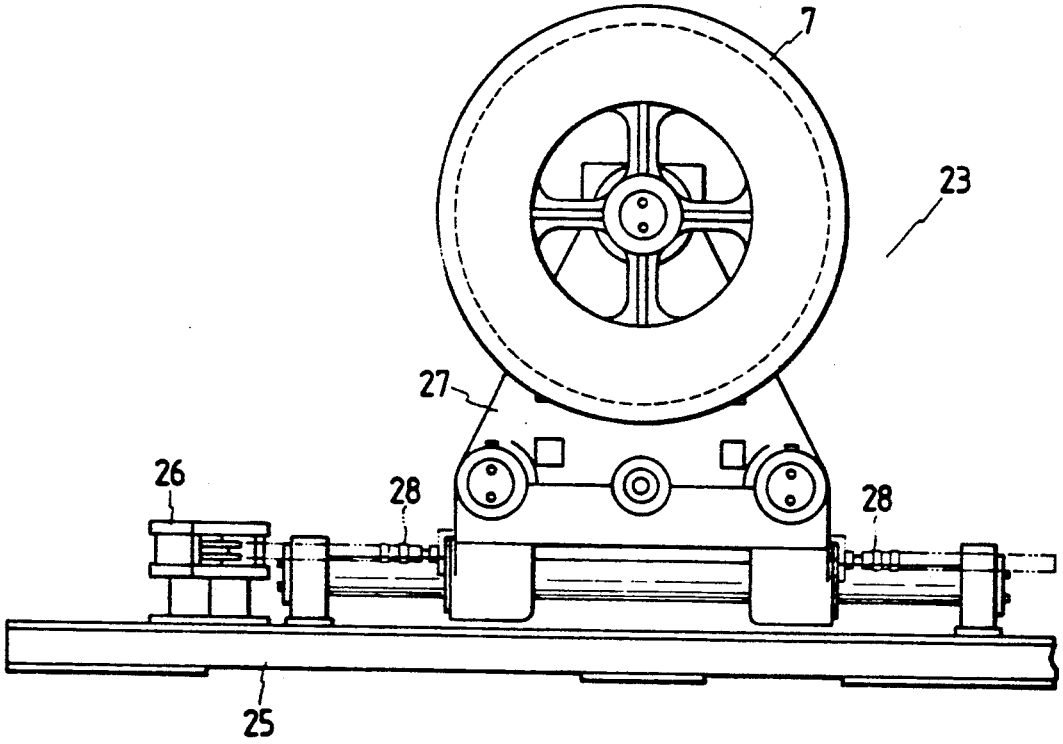
Figure 18:
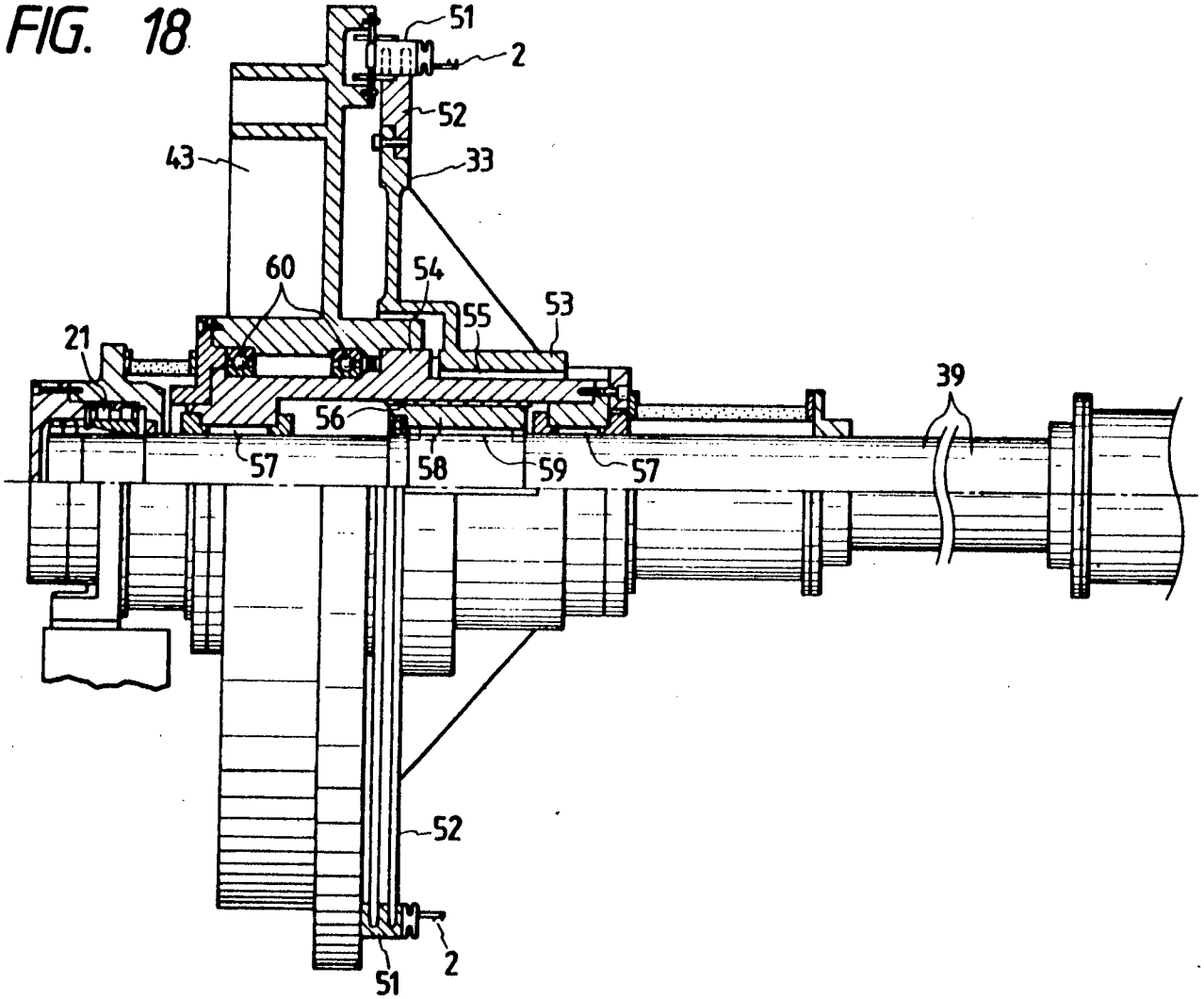
Figure 19:
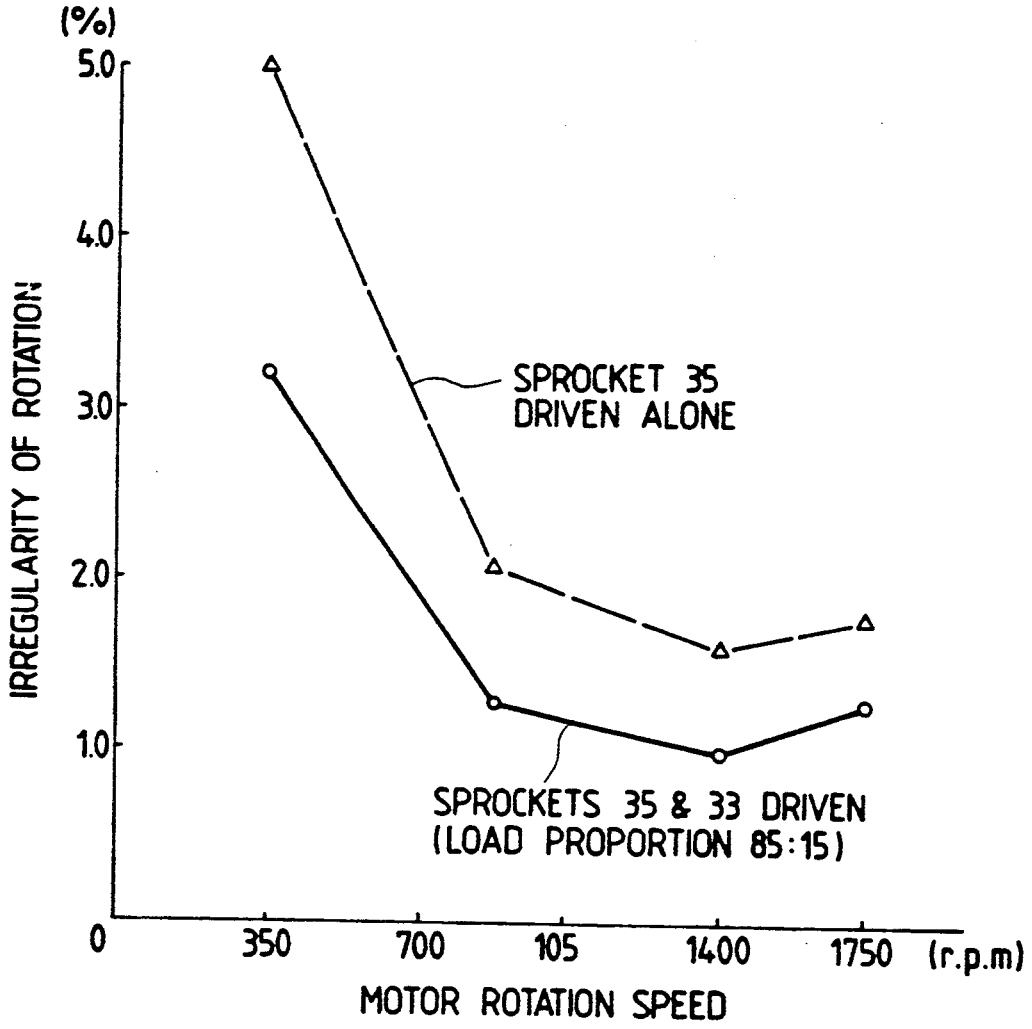

FIGS, 8 and 9 are a plan view and a side view showing a tensioning mechanism in the multistage tenter of the invention;

FIG. 10 is a sectional side view showing a part of a conventional multistage tenter;

FIG. 11 is a perspective view showing clip chains in the conventional multistage tenter;

FIG. 12 is an enlarged plan view showing the conventional clip chain;

FIG. 13 is a sectional view taken along line C—C in FIG. 12;

FIGS. 14 and 15 are a front view and a side view (with parts cut away) showing a direction changing sprocket in the conventional multistage tenter, respectively;

FIGS. 16 and 17 are a plan view and a side view showing a tensioning mechanism in the conventional multistage tenter, respectively;

FIG. 18 is a sectional side view showing a direction changing sprocket and its relevant components in a multistage tenter, a second embodiment of the invention; and FIG. 19 is a graphical representation indicating the relation between the speed of an electric motor and the irregularity of rotation of sprockets (32) in the second embodiment of the invention.

DETAILED DESCRIPTION OF THE INVENTION

Embodiment 1

A first embodiment of this invention will be described with reference to FIGS. 1 through 9, in which components equivalent to those which have been previously described with reference to FIGS. 10 through 17 are therefore designated by the same reference numerals or characters.

Figure 1:
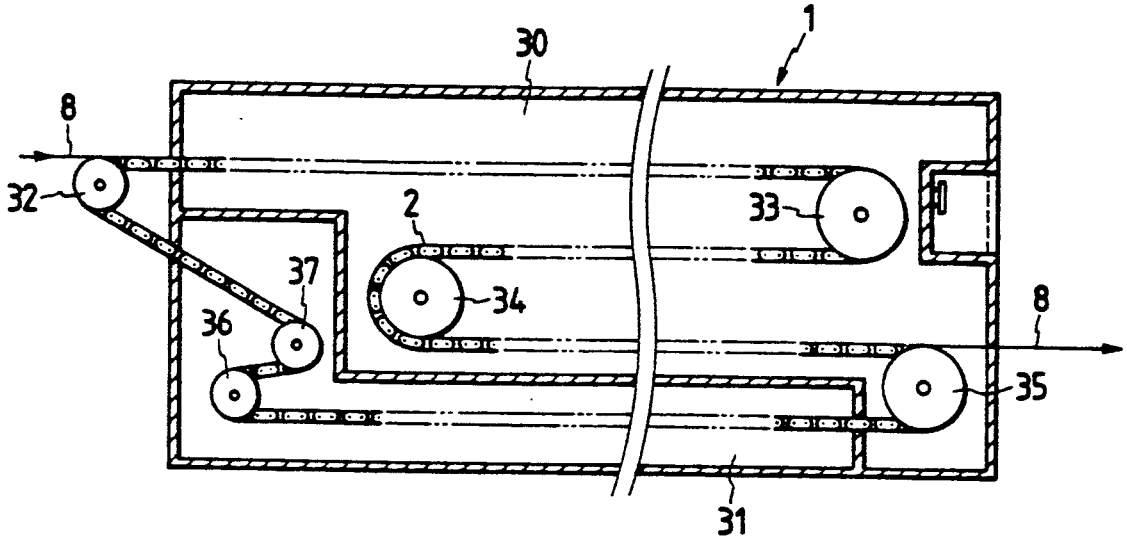
FIG. 1 is a sectional side view showing a part of a multistage tenter, a first embodiment of this invention.

As shown in FIG. 1, a drying unit 1 is divided into a heating chamber 30 and a cooling chamber 31. A sprocket 32 for inserting a film 8 into the drying unit 1 is provided above a film inlet formed in one side wall of the drying unit 1 (which is the left side wall in FIG. 1). Furthermore sprockets 33, 34 and 35 are provided in the heating chamber 30 which are used to change the direction of movement of the film 8 (hereinafter referred to as "direction changing sprockets 33, 34 and 35", when applicable), while a tension sprocket 36 and an idler sprocket 37 are arranged in the cooling chamber 31. The endless clip chains 2 and 2 are laid over those sprockets. Both edge portions of the film 8 are supported by the clip chains 2 through pins 14a formed on the pin plates 14, respectively.

Figure 2:
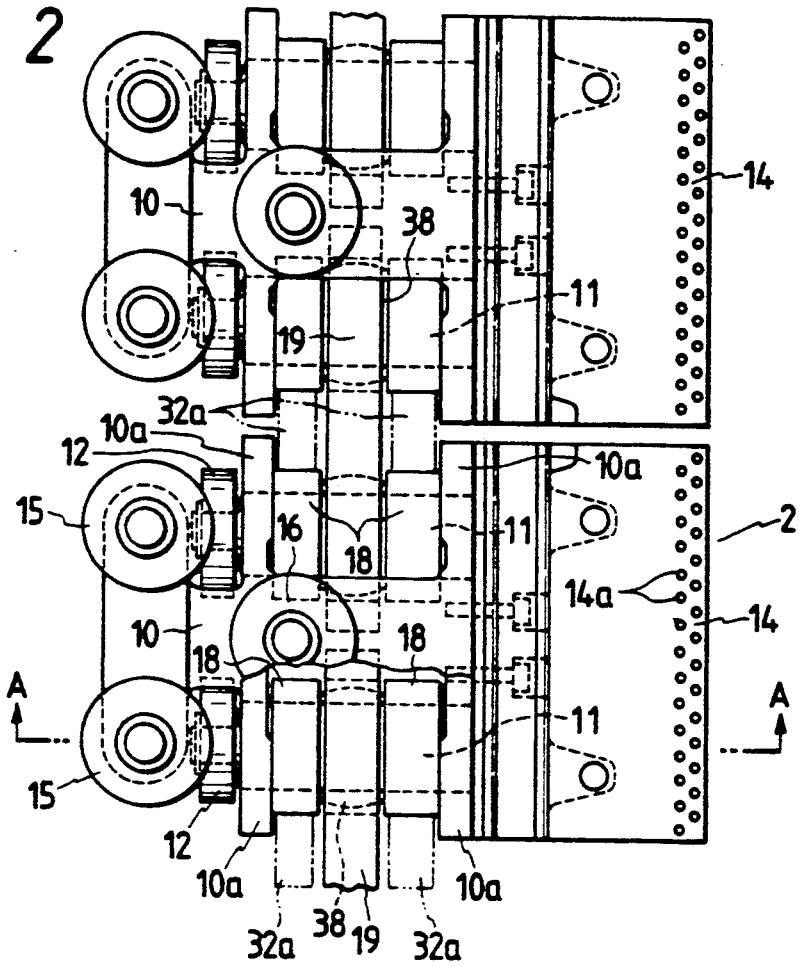
FIG. 2 is an enlarged plan view showing a clip chain in the multistage tenter according to the invention.
Figure 3:
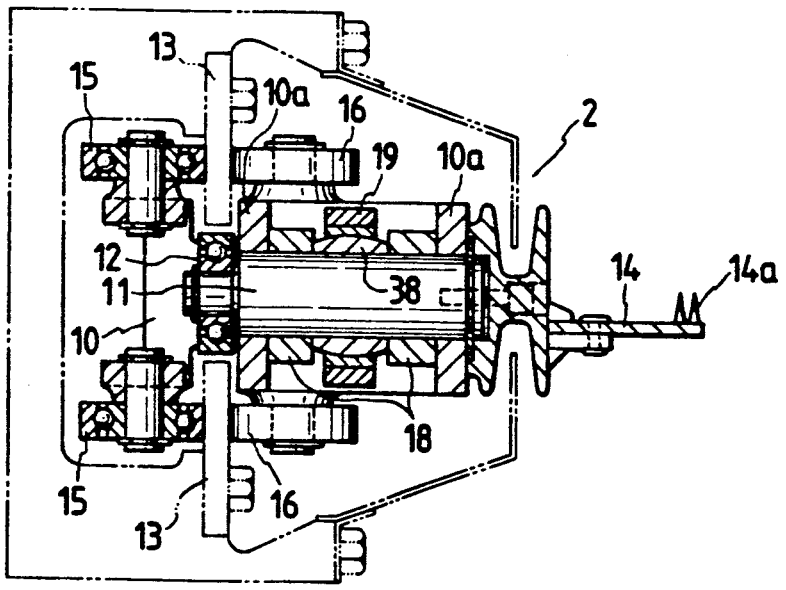
FIG. 3 is a sectional view taken along line A—A in FIG. 2.

The clip chains are as shown in FIGS. 2 and 3. That is, the clip chains are the same as those shown in FIGS. 12 and 13 except the mounting structures of chain links 19 and coupling pins 11. Therefore, only the different components will be described here.

Both ends of each coupling pin 11 are fixedly secured to the side walls 10a of the clip body 10, and a spherical bearing 38 is mounted on the middle portion of the coupling pin 11, and a pair of rollers 18 and 18 are mounted on the coupling pin 11 in such a manner that they are located between the spherical bearing 38 and the side walls 10a of the clip body 10. And a chain link 19 is engaged with the spherical bearings 38 of adjacent clip bodies 10; that is, all the clip bodies 10 are coupled through the chain links 19.

Figure 4:
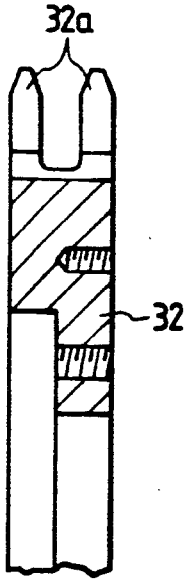
FIGS. 4 and 5 is a sectional side view and a front view showing a part of a sprocket in the multistage tenter according to the invention, respectively.
Figure 5:
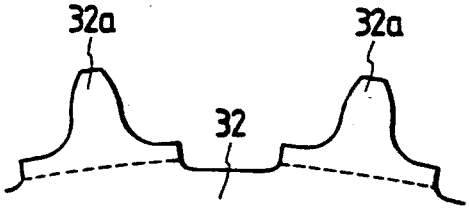

The rollers 18 are engaged with the sprockets 32. Each sprocket 32, as shown in FIGS. 4 and 5, has teeth 32*a* in two lines. In each line, the teeth 32*a* are spaced in such a manner that the teeth are removed every other one in correspondence to the rotors 16 which are provided between the pairs of coupling pins 11. The other sprockets 33 through 37 are equal in structure to the above-described sprocket 32.

When each chain link 19 is engaged with the sprocket, the teeth of the latter are engaged with the rollers 18 mounted on both end portions of the chain link, and the tension is applied through the coupling pin 11 to the middle portion of the coupling pin 11, so that the spherical bearing 38 is slidably rotated around the coupling pin 11. When going over a bend point of the film conveying path, the chain link 19 follows its displacement at the spherical part of the spherical bearing 38. Thus, the clip chains 2 are smoothly moved on.

In the conventional multistage tenter, the chain links 19 are located near the side walls 10*a* of each clip chain body 10 supporting the coupling pin 19, and therefore the coupling pins 11 are scarcely deflected with a chain tension of the order of 400 kg. On the other hand, in the case of the chain links 19 in the above-described embodiment of the invention, a deflection of about 0.003 mm has been obtained per coupling pin 11. This eliminates the difficulty that, in the conventional multistage tenter, the film 8 is liable to be wrinkled because the coupling pins 11 are low in deflection and accordingly the clip chains 2 are high in spring constant.

Now the sprockets for changing the direction of movement of the clip chains will be described.

Figure 6:
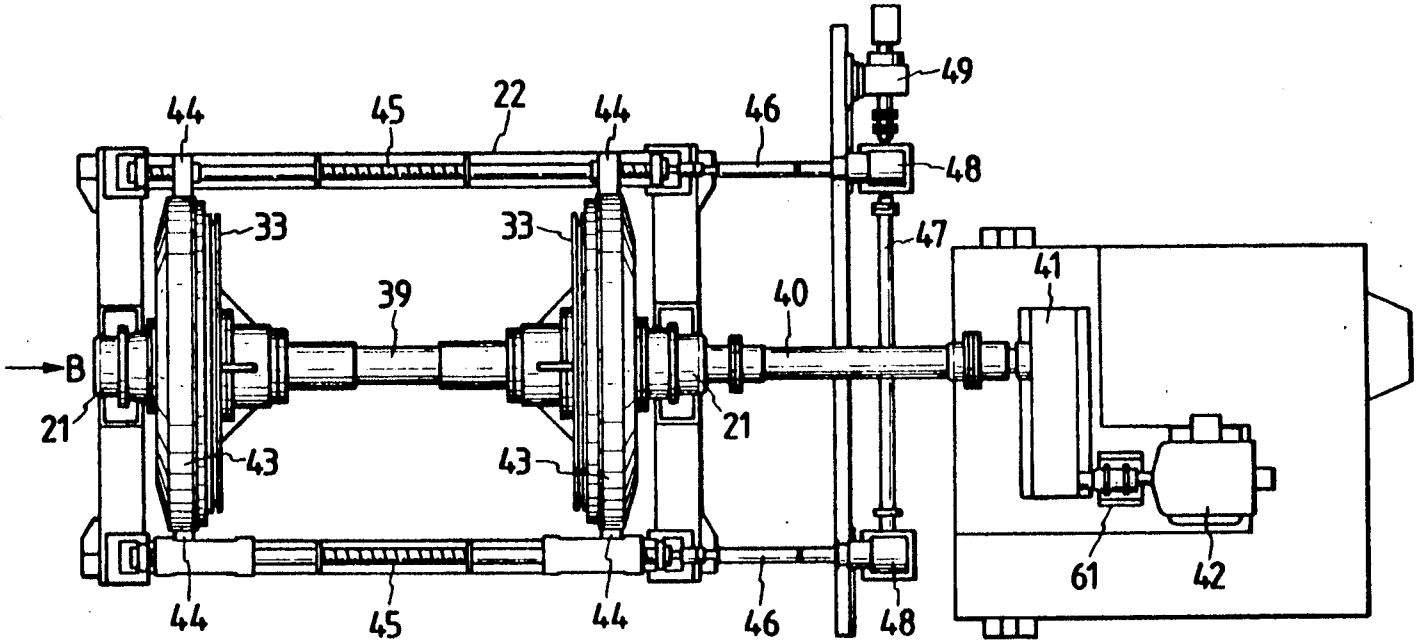
FIG. 6 is a plan view showing a pair of direction changing sprockets with a distance adjusting device in the multistage tenter according to the invention.
Figure 7:
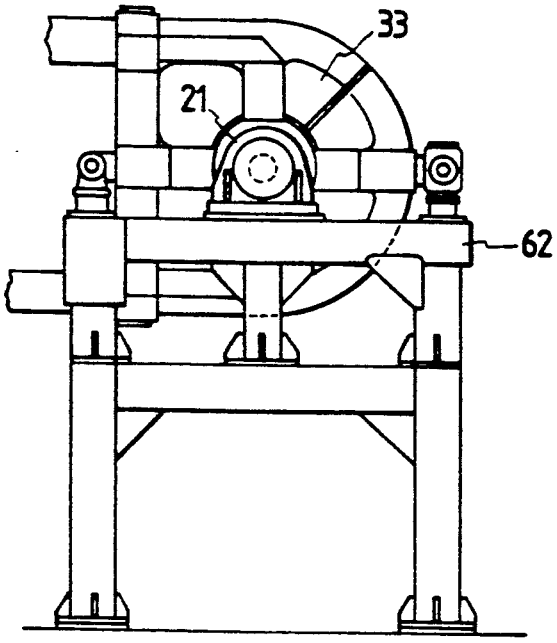
FIG. 7 is a front elevation as viewed in the direction of the arrow B.

As shown in FIGS. 6 and 7, the right and left sprockets 33 are mounted on both end portions of a coupling shaft 39, respectively, which is large in diameter and high in rigidity. The two end portions of the coupling shaft 39 are supported by bearings 21 and 21, respectively. One of the two end portions is extended so that it is coupled to an electric motor 42 through a coupling 40 and a speed reducer 41.

Running rail brackets 43 and 43 are provided outside the sprockets 33 and 33, respectively. Each of the brackets 43 has two slide members 44 and 44 on its periphery. The slide members 44, 44, 44 and 44 are threadably engaged with threaded shafts 45 and 45 as shown in FIG. 6, in such a manner that, when the threaded shafts 45 are driven, the right slide members 44 and 44 and the left slide members 44 are in the opposite directions. The threaded shafts 45 and 45 are coupled through shafts 46 and 46, a coupling 47, worm speed reducers 48 and 48 to a geared electric motor 49. These components 45 through 49 form a distance adjusting device 22.

The sprockets 35 and 35 and their distance adjusting device are the same in construction as the sprockets 33 and its distance adjusting device described above.

Hence, the right and left sprockets for changing the direction of movement of the clip chains are rotated in synchronization. Accordingly, the right and left clip chains 2 are moved synchronously, and the pitch error of the clip chains 2 is forcibly corrected, or absorbed, when the clip chains 2 change the direction of movement at the sprockets. As a result, the difficulty is eliminated that, in the conventional multi-stage tenter, the film 8 is wrinkled because of the difference in length between the right and left clip chains 2.

Figure 8:
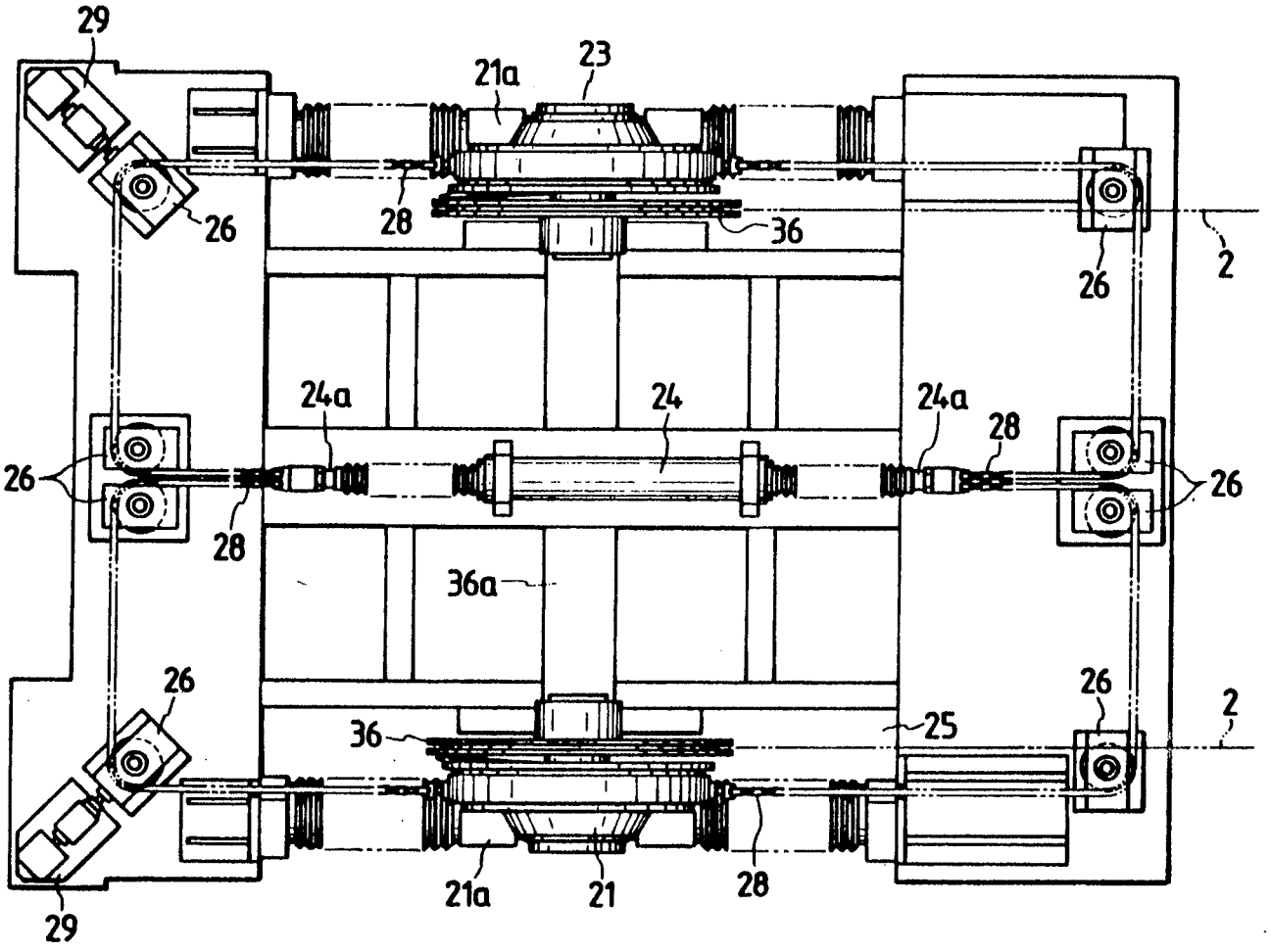
Figure 9:
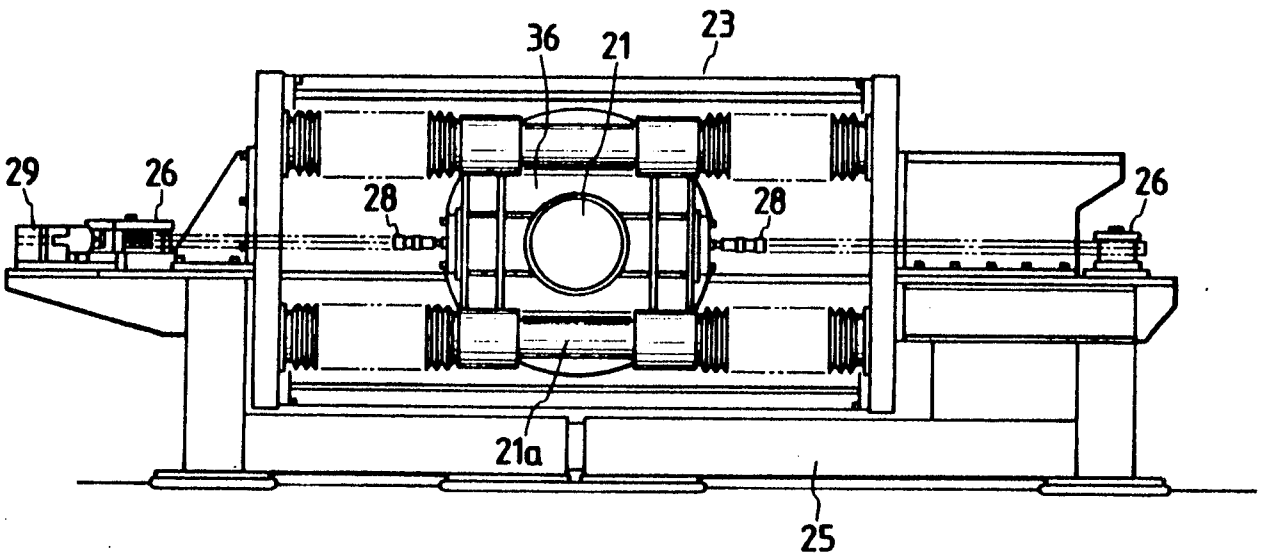

The Tension sprockets 36, as shown in FIGS. 8 and 9, are provided with a tensioning mechanism 23. The tensioning mechanism 23 comprises: a pressure source, namely, a hydraulic cylinder 24 arranged in the central region of a rectangular frame 25 in such a manner that it is extended longitudinally of the frame 25. The shaft 36*a* of the right and left tension sprockets 36 and 36 is laid below the hydraulic cylinder 24 in such a manner that it forms right angles with the latter 24. More specifically, the right and left tension sprockets 36 and their bearings 21 are mounted on the end portions of the sprocket shaft 36*a*, respectively. The bearings 21 are supported by bearing supports 21*a*, respectively, which are so designed, as to be slidable longitudinally of the frame. Eight sprockets holders 26 are installed on the frame 25 in such a manner that four of them are located at four corners of the frame 25, respectively, and two are positioned at the middle of each of the two sides of the frame 25.

Two chains 28 are connected to each of the piston rods 24*a* and 24*a* of the hydraulic cylinder 24. Each of the two chains 28 is laid over the two sprocket holders 26 and 26 and connected to the side of the bearing 21 of the tension sprocket, as shown in FIG. 8. Of the sprocket holders 26 located at the four corners of the frame 25, the two provided respectively for the right and left sprockets 36 and 36 are provided with tension detecting load cells 29, respectively.

Now, the operation of the multistage tenter thus constructed will be described

When the motor 42 is driven, the coupling shaft 39 is rotated through the speed reducer 41 and the coupling 40, so that the right and left sprockets 33 and 33 are rotated synchronously, and the clip chains 2 and 2 laid over the sprockets 33 are moved on. Thus, the film 8 supported on the clip chains 2 and 2 is conveyed smoothly because of the deflection of the coupling pin 11 and the stable contact of the chain links 19 attributing to the spherical bearings 38 mounted thereon.

The distance between the sprockets 33 and 33 can be changed according to the width of a film 8 as follows: When the geared motor 49 is driven, the threaded shafts 45 and 45 are rotated, so that the right slide members 44 and 44 and the left slide member 44 and 44, which are engaged with the threaded shafts 45 and 45, are moved in the opposite directions; that is, the right and left running rail brackets 43 and 43 are moved in the opposite directions. Thus, the distance between the right and left sprockets 33 and 33 can be smoothly changed.

The tensioning mechanism 23 operates as follows:

The four chains 28 are connected between the piston rods 24*a* and 24*a* and the tension sprockets 36 and 36, as shown in FIG. 8. In this case, the connection of the chains 28 are carried out with the distances between the direction changing sprockets 35 and the tension sprockets 36 maintained equal to each other (in FIG. 1).

Then, while the tensions of the chains 28 being detected with the load cells 29 and 29, the piston rod 24*a* is moved in the direction of the arrow (to the right) in FIG. 8, thereby to tension the chains 28 and 28 simultaneously.

It is assumed that the length of the clip chain 2 laid over the sprocket 36 (which is located lower in FIG. 8) is shorter than that of the clip chain 2 laid over the sprocket 36 (which is located upper in FIG. 8). In this case, the tension of the lower clip chain 2 is larger than that of the upper clip chain, so that the lower tension sprocket 36 is slid through the bearing support to the left in FIG. 8. Accordingly, the clip chain 2 laid over the lower tension sprocket is elongated, and the chain links 19 being coupled to the middle portions of the coupling pins 11, the latter 11 are deflected, thus absorbing the pitch error; that is, the clip chains 2 and 2 are made equal in length.

Embodiment 2

A second embodiment of the invention will be described with reference to FIGS. 1, 18, 6, 7 and 19, in which components which are equivalent to those which have been described with reference to FIGS. 10, 11, 14 and 15 are therefore designated by the same reference numerals or characters.

As shown in FIG. 1, a drying unit 1 is divided into a heating chamber 30 and a cooling chamber 31. A sprocket 32 for inserting a film 8 into the drying unit 1 is provided above a film inlet formed in one side wall of the drying unit 1 (which is the left side wall in FIG. 1). Furthermore sprockets 33, 34 and 35 are provided in the heating chamber 30 which are used to change the direction of movement of the film 8 (hereinafter referred to as "direction changing sprockets 33, 34 and 35", when applicable), while a tension sprocket 36 and an idler sprocket 37 are arranged in the cooling chamber 31. The endless clip chains 2 and 2 are laid over those sprockets. Both edge portions of the film 8 are supported by the clip chains 2 through pins 14*a* formed on the pin plates 14, respectively.

The direction changing sprockets will be described. As a typical example of these sprockets, the sprockets 35 will be described. As shown in FIG. 18, a sleeve 54 is engaged through a key 55 with a boss 53 extended horizontally from a disc 52 which has teeth 51. The sleeve 54 has the internal teeth of an involute spline 56 and slide bushings 57 and 57. The sleeve 54 is engaged with a boss 58 having the external teeth of the involute spline 56. The boss 58 is coupled through a key 59 to a coupling shaft 39 which is large in diameter and high in rigidity. As shown in FIG. 6, the direction changing sprockets 35 and 35 are mounted on both end portions of the coupling shaft 39, which are supported by bearings 21 and 21, respectively. One of the end portions of the coupling shaft 39 is extended so that it is coupled through a coupling 40 to a speed reducer 41. The speed reducer 41 is coupled through a coupling 61 to a main electric motor 42, which is electrically connected to auxiliary electric motors (not shown) provided for the sprockets 33.

Running rail brackets 43 and 43 are provided outside the sprockets 35 and 35, respectively. The brackets 43 and 43, as shown in FIG. 18, are mounted through bearings 60 and 60 on the sleeves 54. The other direction changing sprockets 34 and 35 are the same in construction as the above-described sprockets 35.

Now, a distance adjusting device 22 provided for changing the distance between the right and left sprockets 33 will be described.

Each of the running rail brackets 43 and 43 has two slide members 44 and 44 on its periphery. These slide members 44, 44, 44 and 44 are threadably engaged with threaded shafts 45 and 45 which are disposed in parallel with the coupling shaft 39 in such a manner that, when the shafts 45 and 45 are driven, the right slide members 44 and 44 and the left slide members. 44 are moved in the opposite direction. The threaded shafts 45 and 45 are rotatably supported by frames 62 and 62, respectively, and are connected through shafts 46 and 46, worm speed reducers 48 and 48 and a coupling 47 provided between the speed reducers to a geared electric motor 49.

The other direction changing sprockets are also provided with distance adjusting devices which are similar in construction to the above-described one provided for the sprockets 33.

The multistage tenter, the second embodiment, thus constructed operates as follows:

When the main motor 42 is operated, the torque is transmitted through the coupling 61, the speed reducer 41 and the coupling 40 to the coupling shaft 39 to rotate the direction changing sprockets 35 and 35. Accordingly the clip chains 2 and 2 laid over the sprockets are moved, and accordingly the film 8 supported by the clip chains 2 and 2 are conveyed. When the main motor 41 is driven, the auxiliary motors, being electrically connected to the main motor 41, are driven to rotate the sprockets connected thereto.

Means for allowing each auxiliary motor to operate in synchronization with the main motor and for adjusting the output thereof is provided between the main motor and the auxiliary motor. Therefore, the power required for conveying the film may be distributed between the main motor and the auxiliary motors in a certain proportion. For instance, the main motor 42 may output 85% power, and the auxiliary motors 15% power.

FIG. 19 is a graphical representation indicating one example of the relation between the irregularity of rotation of the sprocket 32 and the motor speed. As is apparent from FIG. 19, when the direction changing sprockets 35 are driven alone, the irregularity of rotation of the film inserting sprockets 32 is 1.6 to 5.0% with the motor speed in a range of 350 to 1750 rpm, and in the case where the direction changing sprockets 35 and 33 are driven, the irregularity of rotation is 1.0 to 3.1%, which is smaller by 1.0 to 1.8%. This means that, in the multistage tenter of the invention, the irregularity of rotation of the sprocket 32 being decreased, the film is protected from being wrinkled or from becoming uneven in thickness.

The operation of the distance adjusting device 22 will be described.

When it is required to decrease the distance between the clip chains according to the width of a film to be handled, the geared motor 49 is operated, so that the torque thereof is applied through the worm speed reducers 48 and 48, the coupling 47, and the shafts 46 and 46 to the threaded shafts 45 and 45. As was described before, the slide members 44 and the threaded shafts 45 engaged with the latter 44 are so threaded that, when the threaded shafts 45 are rotated, the right running rail bracket 43 coupled to the right slide members 44 and 44 and the left running rail bracket 43 coupled to the left slide members 44 and 44 are moved in the opposite directions. As the brackets 43 are moved in this manner, the sleeves 54 coupled to the brackets 43 through the bearings 60 are moved, and accordingly the sprockets 33 coupled through the keys 55 to the sleeves are moved.

In this operation, the sleeves 54 are smoothly moved in the axial direction because, in each sprocket, the involute spline 56 is provided between the sleeve 54 and the boss 56, and the slide bushings 57 and 57 are provided between the sleeve 54 and the coupling shaft 39.

In the above description, the auxiliary motors are provided for the direction changing sprockets 33; however, they may be provided for the direction changing sprockets 34, or both of the sprockets 33 and 34. That is, the invention is not limited thereto or thereby.

As was described above, in the multistage tenter of the invention, the tensioning mechanism for providing a tensile force by using one pressure source is provided for the supports of one pair of right and left sprockets engaged with the right and left clip chains, so as to slide the supports thereby to tension the clip chains simultaneously. Therefore, with the multistage tenter, the clip chain shorter in length is automatically increased in tension, whereby the pitch error between the two clip chains is absorbed with the result that the two clip chains are made equal in length. Hence, even when long chain lines are used, they are made equal in length, as a result of which webs such as belt-shaped films can be processed in short time, and the resultant products are excellent in quality having no wrinkles.

Furthermore, according to the invention, the right and left sprockets engaged with the clip chains have the teeth which are arranged in two lines and spaced in such a manner that the teeth are removed every other one, and the chain links of the clip chains are engaged with the middle portions of the coupling pins 19. Therefore, the coupling pins are readily deflected, so that the clip chains can be effectively corrected in length by the tensioning mechanism, and can be smoothly moved.

While there has been described in connection with the preferred embodiments of this invention, it will be obvious to those skilled in the art that various changes and modifications may be made therein without departing from the invention, and it is aimed, therefore, to cover in the appended claims all such changes and modification as fall within the true spirit and scope of the invention.

What is claimed is:

1. A multistage tenter having right and left clip chains (2), which comprises:

a tensioning mechanism (23) comprising one pressure source (24) means for synchronously applying a tensile force on a pair of right and left tension sprockets (36) engaged with said clip chains, said pressure source means comprising means for applying said force directly to a pair of supports for each of said right and left tension sprockets (36) for sliding said supports to tension said right and left clip chains simultaneously such that a pitch error between the two clip chains is absorbed and the two clip chains are made equal in length.

2. A multistage tenter as claimed in claim 1, in which said right and left sprockets engaged with said clip chains each have teeth which are arranged confronted in two lines and spaced in such a manner that every other tooth is removed, and said clip chains have chain links engaged with the middle portions of coupling pins which are engaged with said teeth of said sprockets.

3. A multistage tenter having right and left clip chains, which comprises:

a plurality of pairs of right and left sprockets for changing the direction of movement of said clip chains, said right and left sprockets being connected through respective shafts, and drive sources provided for respective ones of said direction-changing sprockets, said drive sources being electrically connected with each other to synchronize and distribute the force of driving said clip chains to said sprockets.

4. A multistage tenter having right and left endless clip chains, which comprises:

a plurality pair of sprockets for changing a direction of movement of said clip chains, in which at least one of said sprockets being connected through shaft, respectively, and engaged with said endless clip chains;

at least one of driving means for driving one of said sprockets;

tensing mechanism using a power source for applying a tensile force, said tensing mechanism being provided to the supporting portions of one of said sprockets to slide said supporting portion to tense said right and left clip chains simultaneously;

said right and left endless clip chains having plurality rotors being abutted against guide rollers, respectively.

5. The multistage tenter as claimed in claim 4 further comprising auxiliary driving means for driving another pair of sprockets, in which the power required for conveying said film may be distributed between said driving means and said auxiliary driving means in a certain proportion.

6. The multistage tenter as claimed in claim 4 further comprising a distance adjusting device for adjusting a distance between one pair of sprockets.

7. The multistage tenter as claimed in claim 4, wherein said shaft is large in diameter and high in rigidity.

8. A multistage tenter having right and left endless clip chains, which comprises:

a plurality of sprockets for changing a direction of movement of said clip chains, said sprockets being engaged with said endless clip chains, each of said sprockets having teeth which are confronted in two spaced lines;

at least one driving means for driving one of said sprockets;

said right and left endless clip chains comprising: a plurality of clip bodies, a pair of coupling pins mounted on each of said clip bodies, a pair of roller mounted on each of said coupling pins spaced apart from one another and engaged with respective ones of said lines of teeth of said sprockets, and a plurality of rotors rotatably mounted on each of said clip bodies; and chain links engaged with middle portions of said coupling pins between said rollers.

9. The multistage tenter as claimed in claim 8 further comprising auxiliary driving means for driving another pair of sprockets, in which the power required for conveying said film may be distributed between said driving means and said auxiliary driving means in a certain proportion.

10. The multistage tenter as claimed in claim 8 further comprising a distance adjusting device for adjusting a distance between one pair of sprockets.

11. A multistage tenter as claimed in claim 3, wherein said drive sources comprise a main motor for driving one pair of said direction-changing sprockets, and at least one auxiliary motor for driving another pair of said direction-changing sprockets, wherein a driving power of the main motor is relatively larger than a driving power of the auxiliary motor.

* * * * *